United States Patent [19]

King

[11] Patent Number: 5,012,943

[45] Date of Patent: May 7, 1991

[54] SEGMENTED INTERLOCKING TRACKS PRODUCED BY INJECTION MOLDS

[76] Inventor: Nick King, 6161 Portobelo Ct., San Diego, Calif. 92124

[21] Appl. No.: 535,011

[22] Filed: Jun. 7, 1990

[51] Int. Cl.[5] ..... B65D 7/42

[52] U.S. Cl. ..... 220/4.32

[58] Field of Search ..... 220/4.31, 4.32, 4.28

[56] References Cited

U.S. PATENT DOCUMENTS

| | | | |
|---|---|---|---|
| 1,177,847 | 4/1916 | Bosworth et al. | 220/4.31 |
| 2,960,249 | 11/1960 | Walsh | 220/4.31 |
| 3,563,578 | 2/1971 | Mellen | 220/4.32 |
| 4,560,079 | 12/1985 | Godleston et al. | 220/4.32 |

*Primary Examiner*—Joseph Man-Fu Moy

*Attorney, Agent, or Firm*—Selwyn S. Berg

[57] ABSTRACT

A knock-down box produced by injection mold process comprises: a multiplicity of sides and a bottom, a multiplicity of male trapezoidal segments along an edge of the side, an alternating sequence of multiplicity of rectangular tracks and a multiplicity of female trapezoidal segments contiguous and in-line with each other parallel to an edge of the bottom, a dimensioning of the male trapezoidal segments to permit insertion into the rectangular tracks alternately in-line with the female trapezoidal sections, the dimensioning designed to assure a friction slip of the male trapezoid segments along the rectangular track into a captive engagement in female trapezoidal segment assuring a rigid construction of the bottom.

1 Claim, 2 Drawing Sheets

SEGMENTED INTERLOCKING TRACKS PRODUCED BY INJECTION MOLDS

BACKGROUND

Small organizational or storage containers are extremely useful. Such containers are used in the home and office to hold small items. It permits one to organize hardware items or literature or as a file. When not in use, they should be compactly stored. Also, the ability to compact them into a flat package makes mailing, display and warehousing economical. It is important that, when assembled, that such containers be strong. All of these characteristics have been achieved in the past. However, improved technology has introduced new methods of producing such knock-down containers. A very economical production technology is called injection molding. The important aspect of producing an economical product from an injection mold lies in the design of a storage box which can be easily produced from such an injection mold in one step. The inventor researched the concept and discovered that by designing mating trapezoidal male and female segments, a mold may be produced which is simple. In addition, it will produce a box which is strong, easily assembled, compactly stored and low cost.

SUMMARY OF THE INVENTION

In producing a mold, the die must easily separate from the product. This can only occur if no parts of the die become captive in the product or vice versa. The product and the die must separate easily. To produce a product with interlocking pieces, a captive engagement must exist. Hence, this creates the dilemma of how to produce an interlocking die which will free itself from the product.

Necessary research was also conducted to obtain an appropriate segment length for the male and female trapezoid and the adjacent rectangular track. It is important that the sides and bottom of the box engage snugly. However, the sliding friction of the male and female trapezoidal segments is relatively high. If the segments are too long, the components tend to jam and the boxes break. If the segments are too short, it is difficult to align. The maximum length of each segment is a function of the sliding contact carrier, and is determined by trial and error.

The invention is the segmented inter-locking track which is produced by injection molds.

DESCRIPTION OF THE EMBODIMENT

Figure 1:
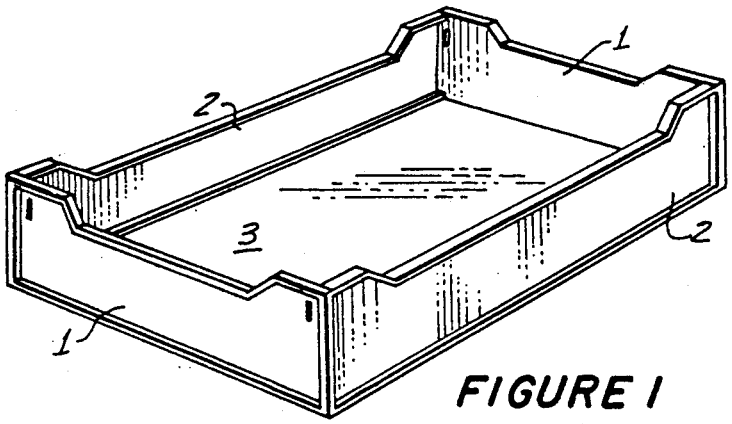
FIG. 1—Drawing showing the assembled box of bottom, sides, and locking endcaps.
Figure 2:
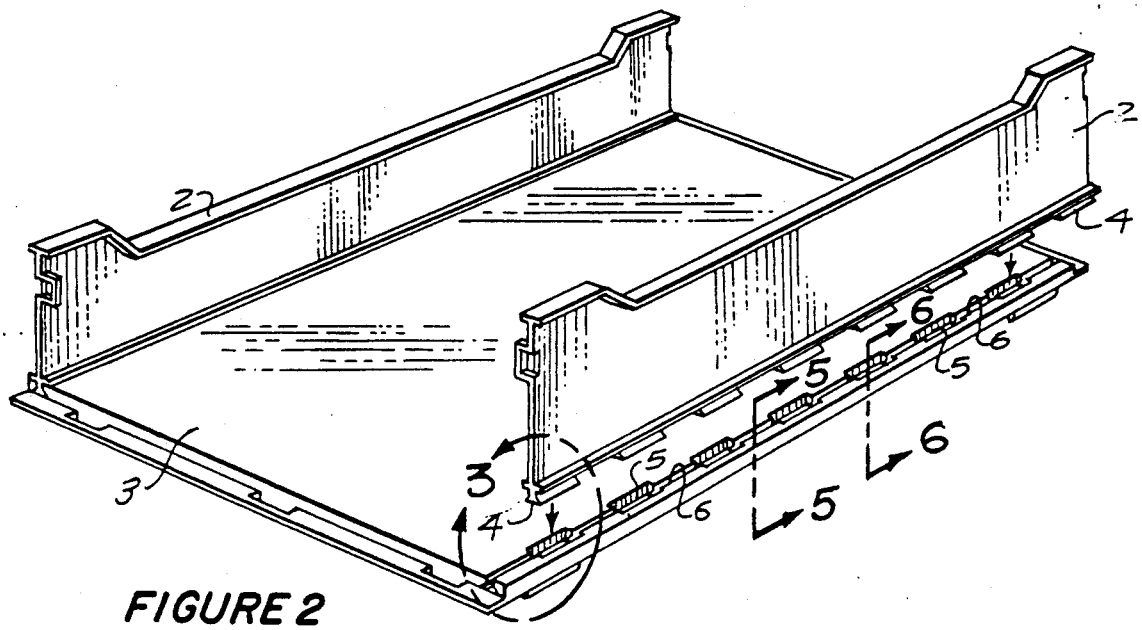
FIG. 2—Showing one side engaged and the other side positioned for engagement.
Figure 4:
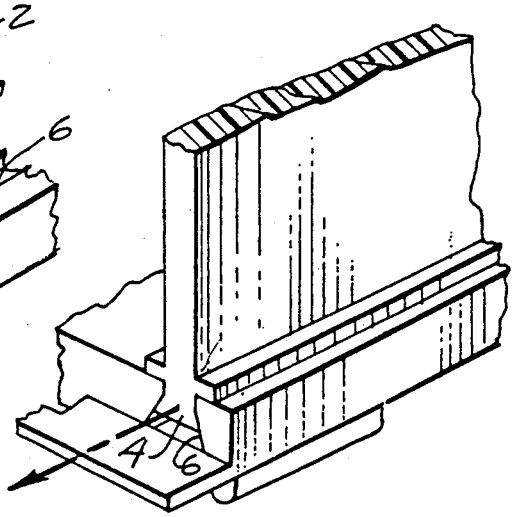
FIG. 4—Shows the side advanced from the rectangular track into lock engagement of the male trapezoidal segment into the female trapezoidal segment.
Figure 6:
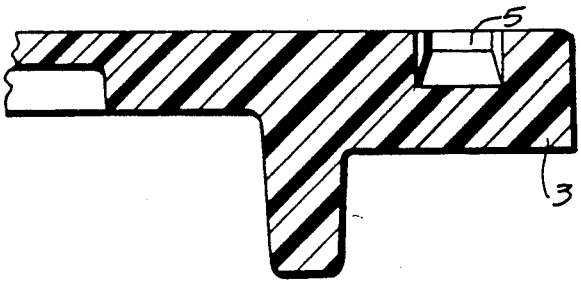
FIG. 6—Show a detail of the blind rectangular segment.
Figure 5:
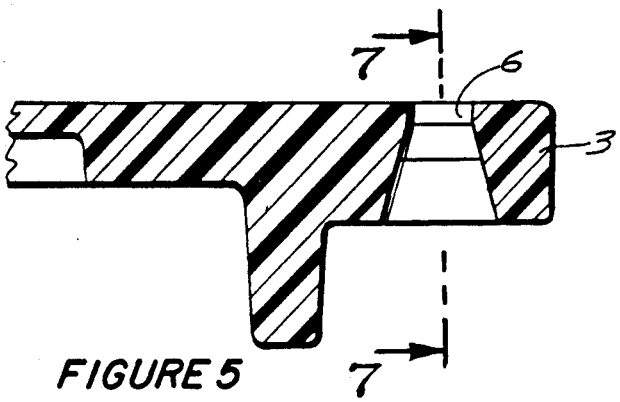
FIG. 5—Shows the detail of the through trapezoidal segment.
Figure 7:
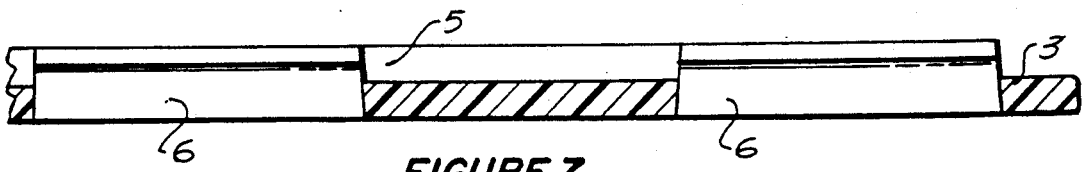
FIG. 7—Shows the sequence in the bottom piece of Section 7 illustrating contiguous female trapezoidal segments with the rectangular track.

An assembled box is shown in FIG. 1. Such a box consists of three sub-assemblies: there are two end caps (1), two sides (2) and one bottom (3). The end pieces are not material to the invention here. They are molded pieces which hinge to the bottom on the shorter dimension and these end pieces can be spring locked to hold onto the sides. FIG. 2 shows one side engaged and the other side to be engaged. The trapezoidal male segment (4) is aligned above the rectangular track (5). The detailed cross-section of the rectangular track and the trapezoidal hole is referenced to FIGS. 5 and 6. By simply inserting the base of the trapezoidal segment into the rectangular track, the uniform engagement is achieved between all but one of the end trapezoidal male segments. The side is then slid along the track and the trapezoidal face slips off the rectangular track into the trapezoidal female section (6) which engages the upper surfaces of the male trapezoidal section which becomes interlocked in the female trapezoidal segment, as shown in FIG. 4. After both sides (2) are tightly engaged into the bottom (3), the end pieces (1) may be hinged and locked. This system produces a strong interlock between the male (4) and female (6) trapezoidal segments. A magnified section of the bottom track is shown in FIGS. 5, 6 and 7. FIG. 6 shows the rectangular track (5) in the bottom, and FIG. 5 shows the contiguous female trapezoidal segment (6). FIG. 7 illustrates the sequential series of the rectangular track (5) with female trapezoidal segment (6). FIGS. 5, 6 and 7 imply the simple injection molding process which is a material part of the practical utility of the invention. The top half of the die which produces the bottom (3) can be easily separated from the product because of the rectangular structure of said rectangular track (5). The lower half of the bottom die can likewise be easily separated from the product because of the taper of the through female trapezoidal segment (6).

Figure 3:
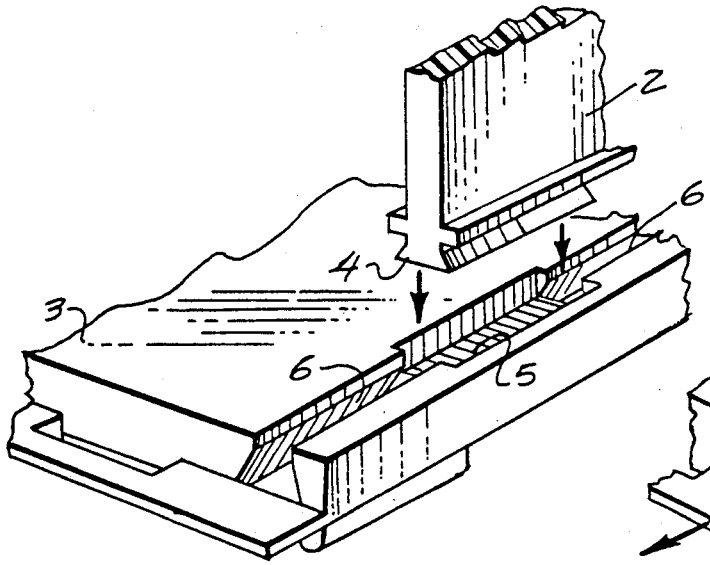
FIG. 3—Shows a Section 3 enlargement illustrating the alignment of male trapezoidal segment with rectangular track.

A simple mold is generally produced from two die segments. The material is injected into the mold, and when the segments are separated, the product may be easily removed. Reference to FIG. 3 shows a section of a side component of the box prior to assembly. The male trapezoid is easily produced along with the rest of the side by a pair of dies which are essentially mirror images of each other. So when the die components are separated, the product recovered has a symmetrical trapezoidal shape with a base which is wider than the upper section. It should be clear that the die components will free easily because there are no captive segments. The bottom of the box must be produced by a pair of die components which are, for the most part, asymmetrical. Herein lies the point of the invention for the product. Inspection of FIG. 5 shows the through segment of the female track which has a trapezoidal-like hole. The die producing this section is removed by separating that portion of the die from the lower part of the box bottom. Reference to FIG. 6 shows an adjacent segment of a rectangular track which is easily produced by the top die of the bottom mold. Separation of the die segments of the mold easily clears the products when the mold is open. Features of the product is that it can be easily produced from a simple injection mold.

The box may be disassembled in the reverse order. That is, unlock and unhinge the endcaps, slide the sides into alignment so that the male trapezoidal segment may be slipped out from the rectangular track.

This particular embodiment illustrates the practical use of the geometry of the segments in producing a box as illustrated. However, other embodiments are also possible for rigid containers of various size and shapes. The leading objective of the invention is the utilization of appropriate geometries that produce a knock-down container of some assemblies which are products of a simple injection mold.

The inventor claims:

1. A knock-down box produced by injection mold process comprising:

a multiplicity of sides and a bottom, a multiplicity of male trapezoidal segments along a edge of said side, an alternating sequence of a multiplicity of rectangular tracks and a multiplicity of female trapezoidal segments contiguous and in-line with each other parallel to an edge of said bottom, a dimensioning of said male trapezoidal segments to permit insertion into said rectangular tracks alternately in-line with said female trapezoidal sections, said dimensioning designed to assure a friction slip of said male trapezoidal segments along said rectangular track into a captive engagement in female trapezoidal segment assuring a rigid construction of said sides with said bottom, a multiplicity of end caps which hinge and lock said sides to said bottom resulting in a box structure which may be likewise disassembled and stored flat, said trapezoidal and rectangular segments shape being compatible with elementary injection molding techniques to accomplish a low cost container product.

* * * * *